US007609589B1

(12) United States Patent
Sheu

(10) Patent No.: US 7,609,589 B1
(45) Date of Patent: Oct. 27, 2009

(54) PERPETUAL CALENDAR CLOCK

(76) Inventor: Kuei-Wen Sheu, 2F.-5, No. 367, Sec. 1, Si-an St., Beitou District, Taipei City (TW)

( * ) Notice: Subject to any disclaimer, the term of this patent is extended or adjusted under 35 U.S.C. 154(b) by 0 days.

(21) Appl. No.: 12/335,523

(22) Filed: Dec. 15, 2008

(51) Int. Cl.
*G04B 19/02* (2006.01)
*G04B 19/06* (2006.01)
*G04B 19/20* (2006.01)

(52) U.S. Cl. ..... 368/39; 368/222; 368/235

(58) Field of Classification Search ..... 368/28, 368/37, 39, 40, 76, 78, 220, 222, 235
See application file for complete search history.

(56) References Cited

U.S. PATENT DOCUMENTS 2,927,418 A * 3/1960 Bauer ..... 368/39
4,027,469 A * 6/1977 Yaguinuma ..... 368/39
4,122,659 A * 10/1978 Hashimoto ..... 368/78
4,193,256 A * 3/1980 Tobeta et al. ..... 368/74
4,214,134 A * 7/1980 Ogihara et al. ..... 200/37 R
4,298,972 A * 11/1981 Ogihara et al. ..... 368/222
5,274,616 A * 12/1993 Shu ..... 368/39
2005/0111305 A1* 5/2005 Sheu ..... 368/76

* cited by examiner

*Primary Examiner*—Vit W Miska
(74) *Attorney, Agent, or Firm*—Chun-Ming Shih

(57) ABSTRACT

A perpetual calendar clock includes an outer case that has a month window, a date window, a day-of-the-week window, and a clock window formed on the surface thereof. The clock includes a rotatory wheel set, a driving apparatuses, a clock-control unit, and a battery set, which are all fixed within the hollow outer case. The rotatory wheel set has a month wheel, a date wheel, and a day-of-the-week wheel, which, respectively, are aligned to the month window, the date window, and the day-of-the-week window of the outer case. Also, the clock-control unit is aligned to the clock window. The clock-control unit sends a signal for controlling and actuating deflecting rods, micro switches, and touch switches of the driving apparatuses so that the driving apparatuses act with the buses on a flexible circuit board disposed within one of the wheels; then, another control signal is sent to another wheel. Thus, the month wheel, the date wheel and the day-of-the-week wheel are actuated so as to turn to the correct month, the date and the day-of-the-week.

11 Claims, 9 Drawing Sheets

PERPETUAL CALENDAR CLOCK

BACKGROUND OF THE INVENTION

1. Field of the Invention

The present invention relates to an improved structure of a perpetual calendar clock and, particularly, to an improved structure of a perpetual calendar clock in which a rotatory wheel set, flexible circuit boards, and driving apparatuses are used to generate intermittent signals and clock-control signals for driving a date wheel, a month wheel, and a day-of-the-week wheel to turn.

2. Description of the Prior Art

A common structure of a mechanical perpetual calendar usually requires numerous mechanically controlled components for connection and for control so that the date, the day of the week and the month displayed can be altered automatically. Such a structure has a disadvantageous large volume; also, the cost in its production cannot be lowered effectively. The perpetual calendar is thus under great competition pressure in the industry.

An improved structure of a conventional perpetual calendar clock comprises an outer case, rotatory wheels, a driving apparatus, a clock-control unit, and a battery set for supplying power. The outer case has a date window, a month window, a day-of-the-week window, and a clock window formed on the surface thereof. The outer case is hollow and contains the rotatory wheels, the driving apparatus, the clock-control unit and the battery set, which are all fixed within the outer case. The clock-control unit can trigger a signal for controlling the actuation of the driving apparatus. The driving apparatus is linked to a day-of-the-week wheel, a date wheel and a month wheel, which are circulated in sequence, and uses a contact surface of a substrate disposed therein for automatic alternation between those solar months without operation done by hand. The driving apparatus has a motor used for driving a gear set and the gear set controls a brake handle so that a brake switch generates signals. The driving apparatus comprises heavy means which occupy the most space and tend to have a linkage failure.

Since the convention has such drawbacks as described above, it is hardly a good one. An improvement is required urgently.

In view of the above difficulties associated with the conventional structure, the present inventor, through a long-term study and practice, has set about the work of improvement and innovation that provides the present improved structure of a perpetual calendar clock.

SUMMARY OF THE INVENTION

The primary objective of this invention is to provide an improved structure of a perpetual calendar clock that uses signals from a clock-control unit to activate driving apparatuses and, further, to control the driving apparatuses so that a date wheel, a month wheel, and a day-of-the-week wheel are turned and a date tab, a month tab, and a day-of-the-week tab are properly displayed.

Another objective of this invention is to provide an improved structure of a perpetual calendar clock that has one driving apparatus disposed within each wheel of a rotatory wheel set and cooperated with the circuit and touch surface of one flexible circuit board, so that the day-of-the-week wheel, the date wheel, and the month wheel of the rotatory wheel set are driven to rotate, wherein as a touch point of the driving apparatus contacts the buses on the flexible circuit board, a signal is generated to activate the driving apparatus within another wheel so as to activate the day-of-the-week wheel, the date wheel, and the month wheel in sequential circulation.

An improved structure of a perpetual calendar clock that can fulfill the inventive objectives comprises an outer case, a rotatory wheel set, three driving apparatuses, and a clock-control unit. The outer case has a month window, a date window, a day-of-the-week window, and a clock window formed on the surface thereof. The outer case is hollow and contains the rotatory wheel set, the driving apparatuses, the clock-control unit, and a battery set, which are all fixed within the outer case. The rotatory wheel set consists of a month wheel, a date wheel, and a day-of-the-week wheel, which, respectively, are aligned to the month window, the date window, and the day-of-the-week window of the outer case. Also, the clock-control unit is aligned to the clock window. Upon one cycle of rotation of an hour hand of the clock-control unit, a signal is sent for controlling and actuating deflecting rods, micro switches, and touch switches of the driving apparatuses. As the month wheel, the date wheel and the day-of-the-week wheel begin to rotate under control of the deflecting rods of the driving apparatuses, buses disposed on a flexible circuit board that are annularly disposed within one of the wheels can contact the touch switch of the driving apparatus associated with the wheel and then another signal is sent to another one wheel. Thus, the month wheel, the date wheel and the day-of-the-week wheel are actuated in sequential circulation. By means of those elements described above, the present invention provides the improved structure of a perpetual calendar clock. Through the cyclic actuation of the driving apparatuses, step control signals are generated so as to turn the month wheel, the date wheel and the day-of-the-week wheel, fulfilling the purpose for tab display of the month, the date and the day of the week.

These features and advantages of the present invention will be fully understood and appreciated from the following detailed description of the accompanying drawings.

DETAILED DESCRIPTION OF THE PREFERRED EMBODIMENT

Refer to FIGS. 1A, 1B, 1C and FIG. 2. As shown, the improved structure of a perpetual calendar clock, according to the present invention, comprises the following elements.

Figure 5:
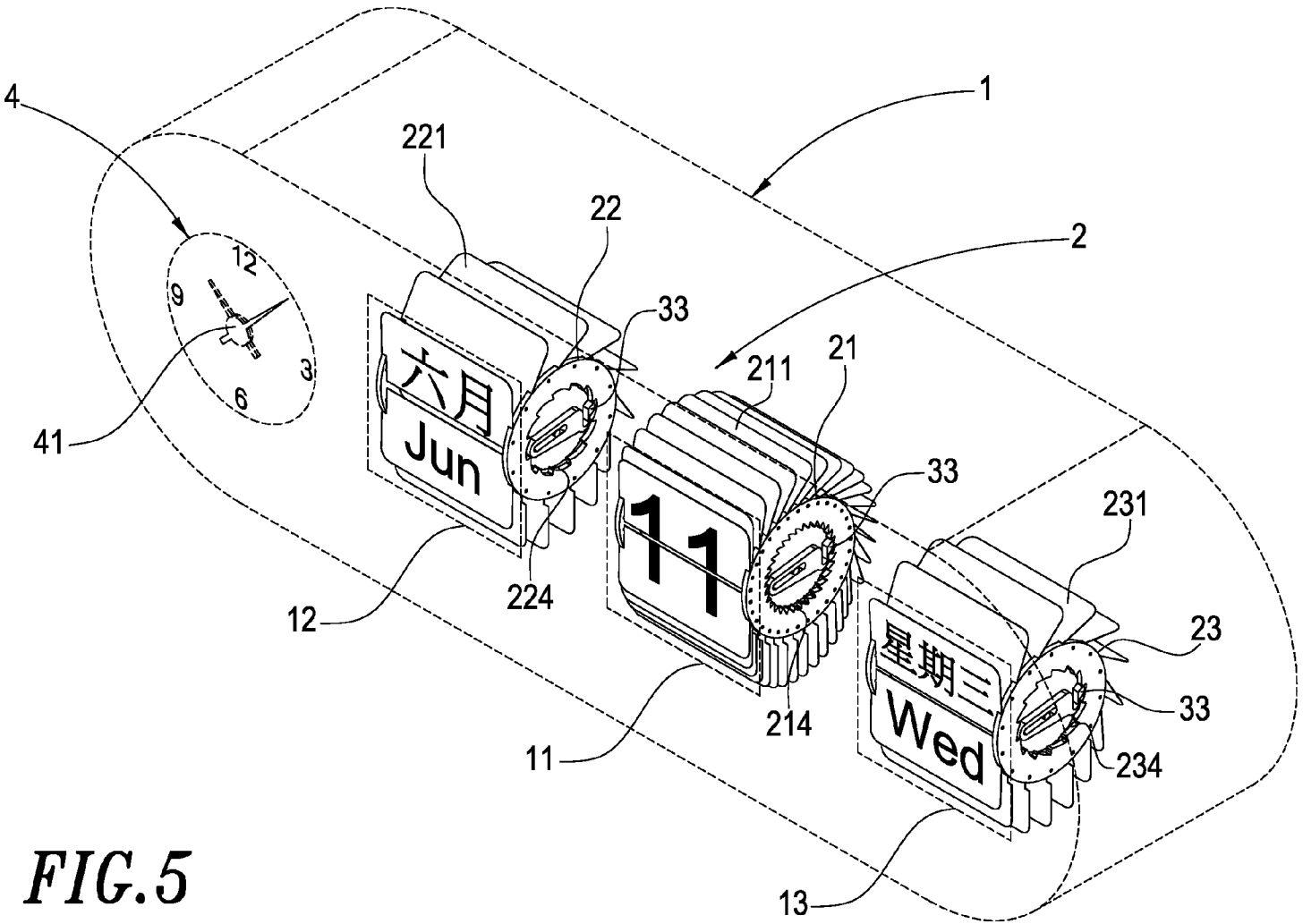
FIG. 5 is a view of the improved structure of a perpetual calendar clock, as is a complete product.

An outer case 1, referring to FIG. 5, has a month window 11, a date window 12, a day-of-the-week window 13, and a clock window 14 formed on one side surface thereof. Optionally, the outer case 1 has other functional windows formed on one side surface thereof.

A rotatory wheel set 2, consists of a month wheel 21, a date wheel 22, and a day-of-the-week wheel 23. The wheels 21-23, respectively, have a month tab 211, a date tab 221, and a day-of-the-week tab 231 disposed annularly thereon. The wheels 21-23, respectively, are aligned to the month window 11, the date window 12, and the day-of-the-week window 13 of the outer case 1. The wheels 21-23, respectively, have annular flexible circuit boards 212-232 disposed therein. The wheels 21-23, respectively, have more than one bus 213-233 disposed annularly on the inner surface thereof. The wheels 21-23, respectively, have inner ratchet wheels 214-234 disposed at one edge thereof. The wheels 21-23, respectively, have more than one bump 215-235 disposed on the inner surface of the edge other than that where the inner ratchet wheels 214-234 are disposed. In the month wheel 21, the month tab 211 consists twelve pages; both the number of the ratchets of the inner ratchet wheel 214 and the number of the bumps 215 are equal to this number of pages of the month tab 211. In the date wheel 22, the date tab 221 consists thirty-one pages; both the number of the ratchets of the inner ratchet wheel 224 and the number of the bumps 225 are equal to this number of pages of the date tab 221. In the day-of-the-week wheel 23, the day-of-the-week tab 231 consists fourteen pages, of which two pages are used for each one day to display the AM time as well as the day of the week and to display the PM time as well as the day of the week; also, both the number of the ratchets of the inner ratchet wheel 234 and the number of the bumps 235 are equal to the number of pages of the day-of-the-week tab 231. The month wheel 21, the date wheel 22 and the day-of-the-week wheel 23 of the rotatory wheel set 2, respectively, are aligned to the month window 11, the date window 12, and the day-of-the-week window 13 on the surface of the outer case 1; a clock control unit 4 is aligned to the clock window 14 on the surface of the outer case 1.

Three driving apparatuses 3 (referring to FIGS. 1A, 1B and 1C), respectively, are placed within the month wheel 21, the date wheel 22 and the day-of-the-week wheel 23 of the rotatory wheel set 2, and then fixed within the outer case 1. The driving apparatuses 3, respectively, drive the month wheel 21, the date wheel 22 and the day-of-the-week wheel 23 to rotate. Each of the driving apparatuses 3 comprises a motor 31, a gear set 32, a deflecting rod 33, a touch switch 34, and a micro switch 35. The front end of the deflecting rod 33 is placed on the inner ratchet wheel; the touch terminals of the touch switch 34 touch the buses on the flexible circuit board; the micro switch 35 is disposed so as corresponding to the bumps 235. The number of the touch terminals of the touch switch 34 is determined by the number of the buses on the flexible circuit board; for example, there are three terminals if three are three buses.

A clock-control unit 4 is fixed at the clock window 14 of the outer case 1. The clock-control unit 4 consists of an hour hand 41, a rotatory touch piece 42, and a control substrate 43. Through the rotation of the hour hand 41, the rotatory touch piece 42 is driven so as to touch a contact surface of the control substrate 43. Upon one cycle of rotation of the hour hand 41 per twelve hours, a signal is triggered for controlling and actuating the driving apparatus 3.

By means of those elements described above, which can be combined within the outer case 1, the present invention provides the improved structure of a perpetual calendar clock as shown in FIG. 5. Through the cyclic actuation of the driving apparatuses 3, step control signals are generated so as to turn the month wheel 21, the date wheel 22 and the day-of-the-week wheel 23, fulfilling the purpose for tab display of the date, the month and the day of the week. The actuation according to the present invention utilizes electric power supplied by a battery set 5.

Figure 1A:
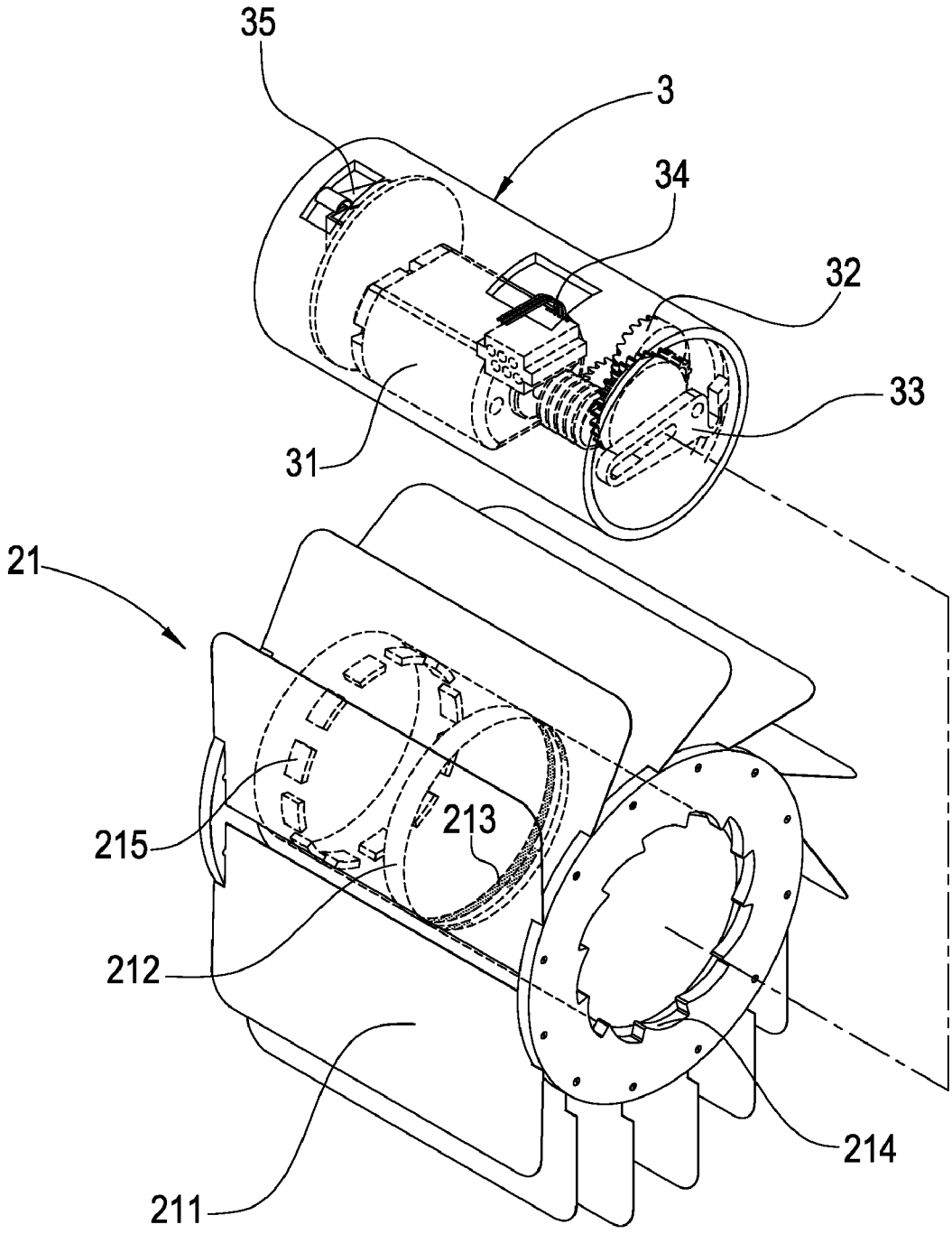
FIGS. 1A, 1B and 1C are, respectively, partial views of the driving apparatuses within the date wheel, the month wheel, and the day-of-the-week wheel of the improved structure of a perpetual calendar clock according to the present invention.
Figure 1B:
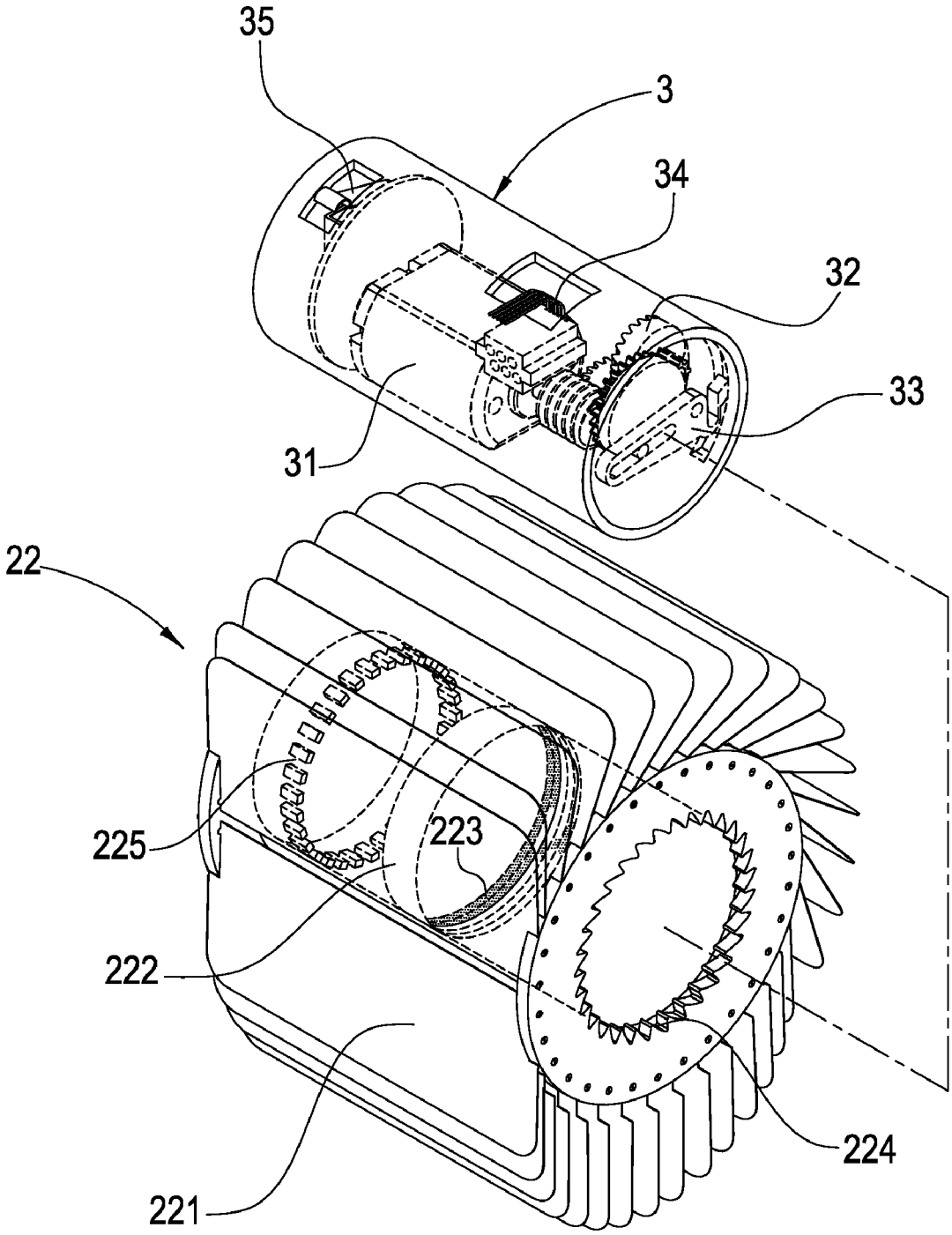
Figure 1C:
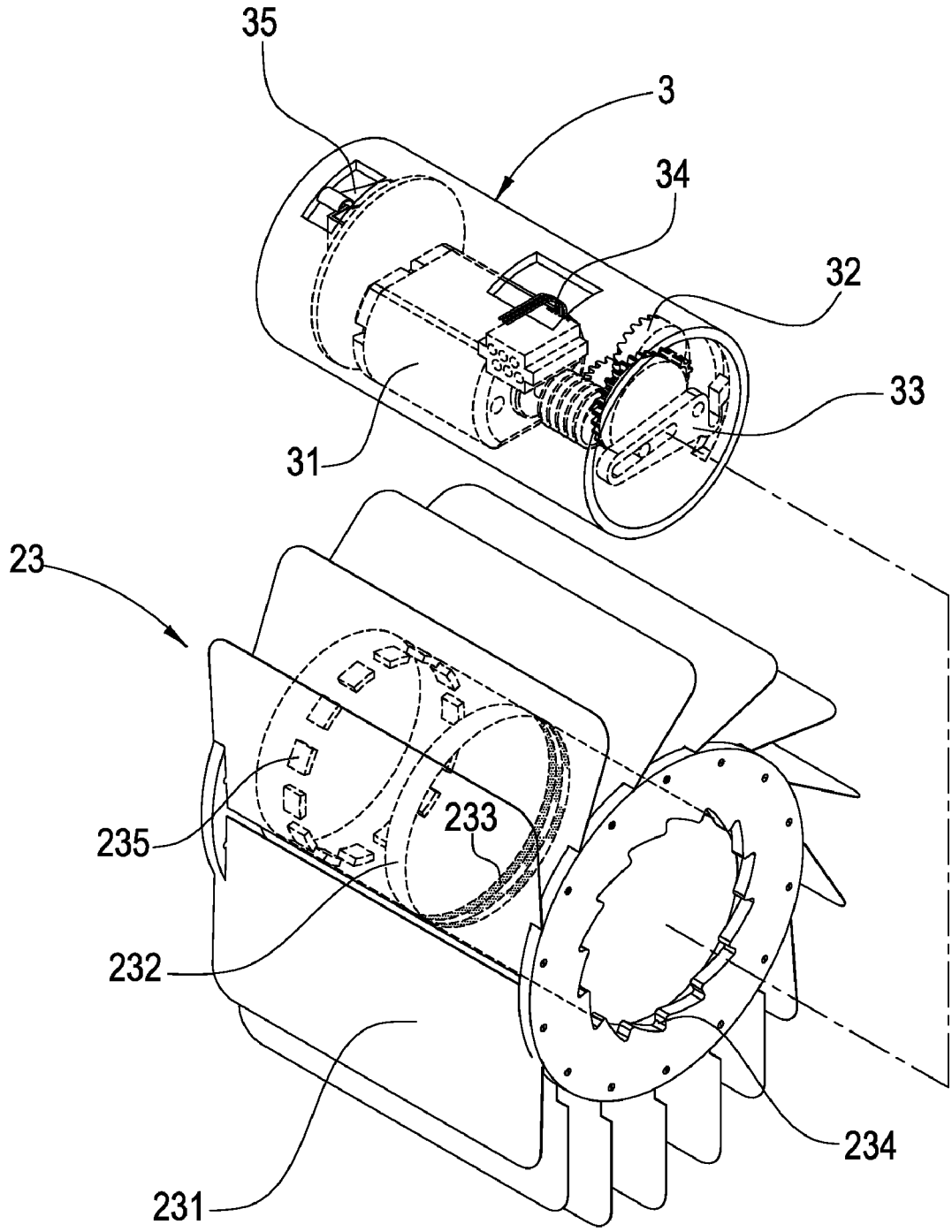
Figure 2:
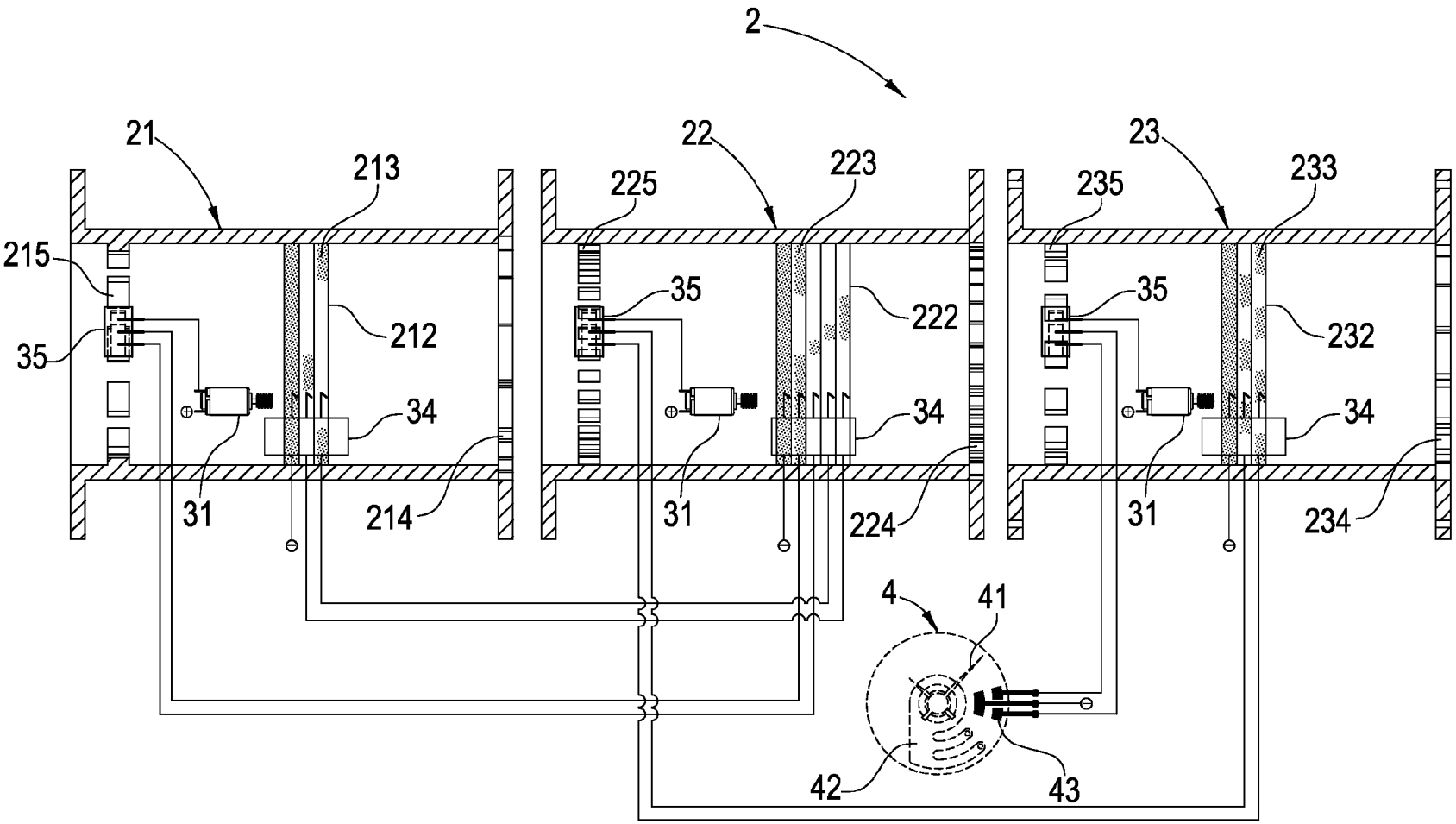
FIG. 2 is a schematic diagram of the improved structure of a perpetual calendar clock, shown with respect to the control signals.
Figure 3A:
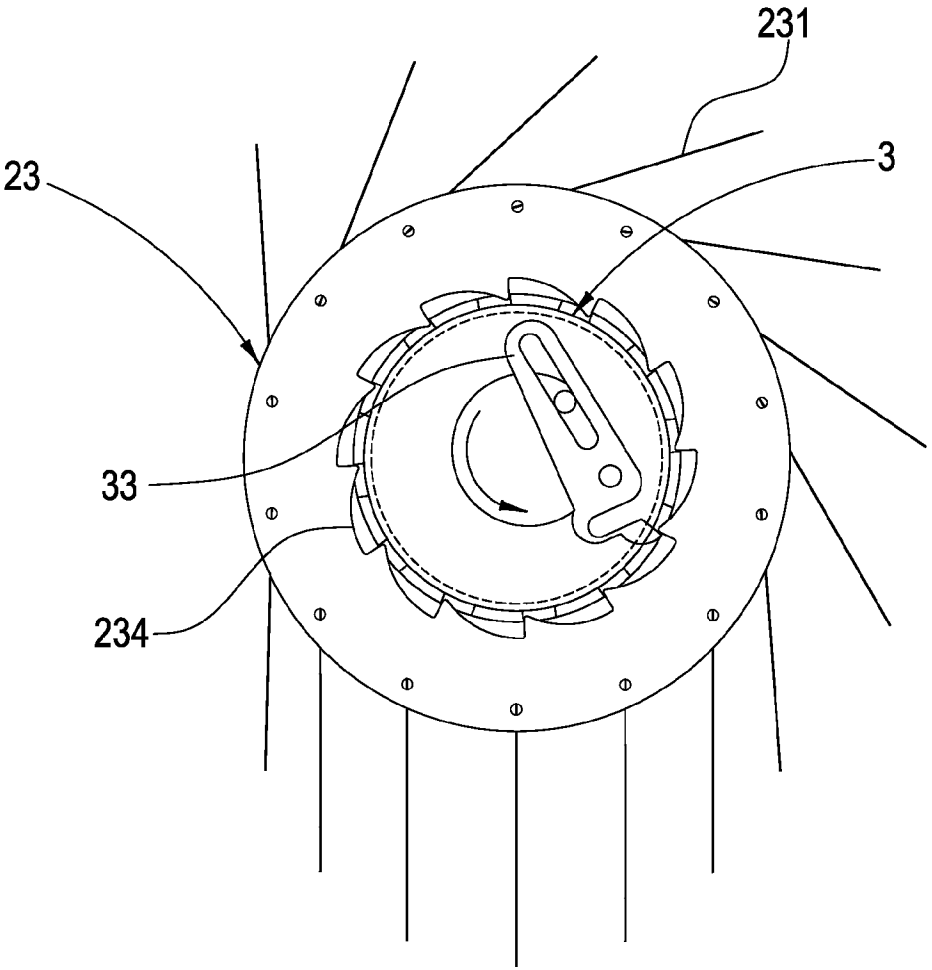
FIGS. 3A and 3B are views of one side of the day-of-the-week wheel of the improved structure of a perpetual calendar clock, with respect to the implementing states.
Figure 3B:
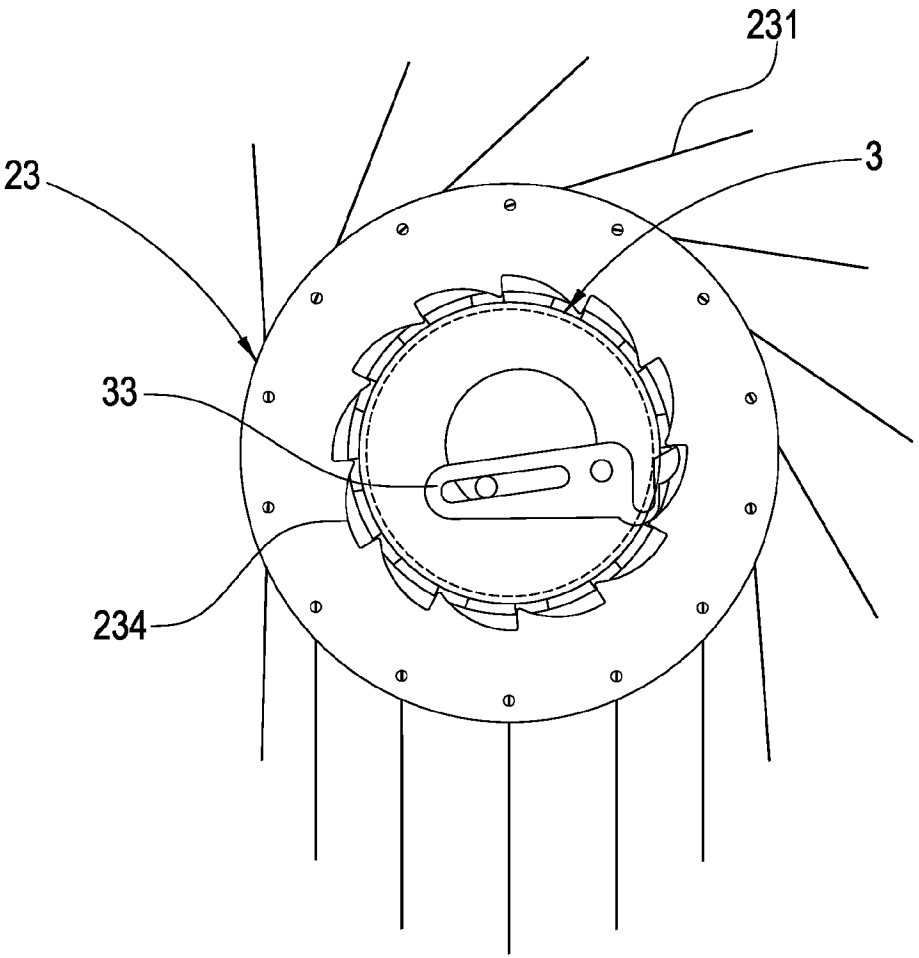
Figure 4A:
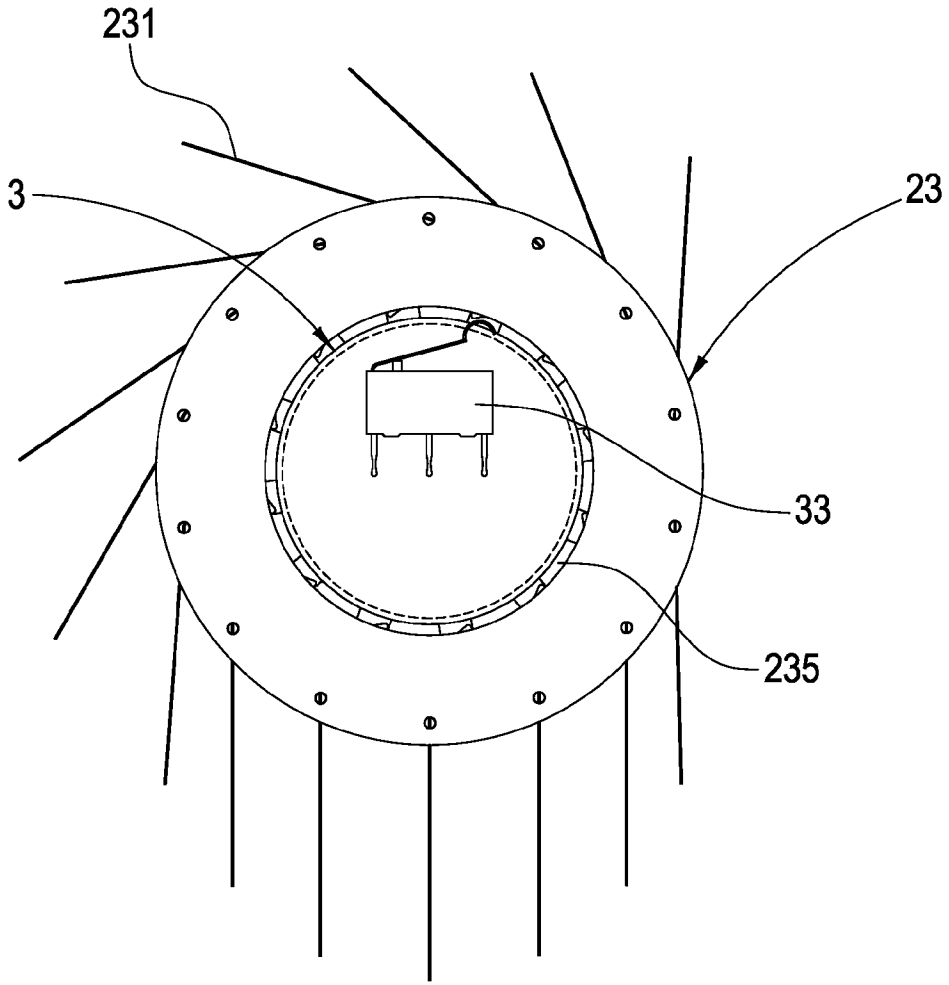
FIGS. 4A and 4B are views of another side of the day-of-the-week wheel of the improved structure of a perpetual calendar clock, with respect to the implementing states.
Figure 4B:
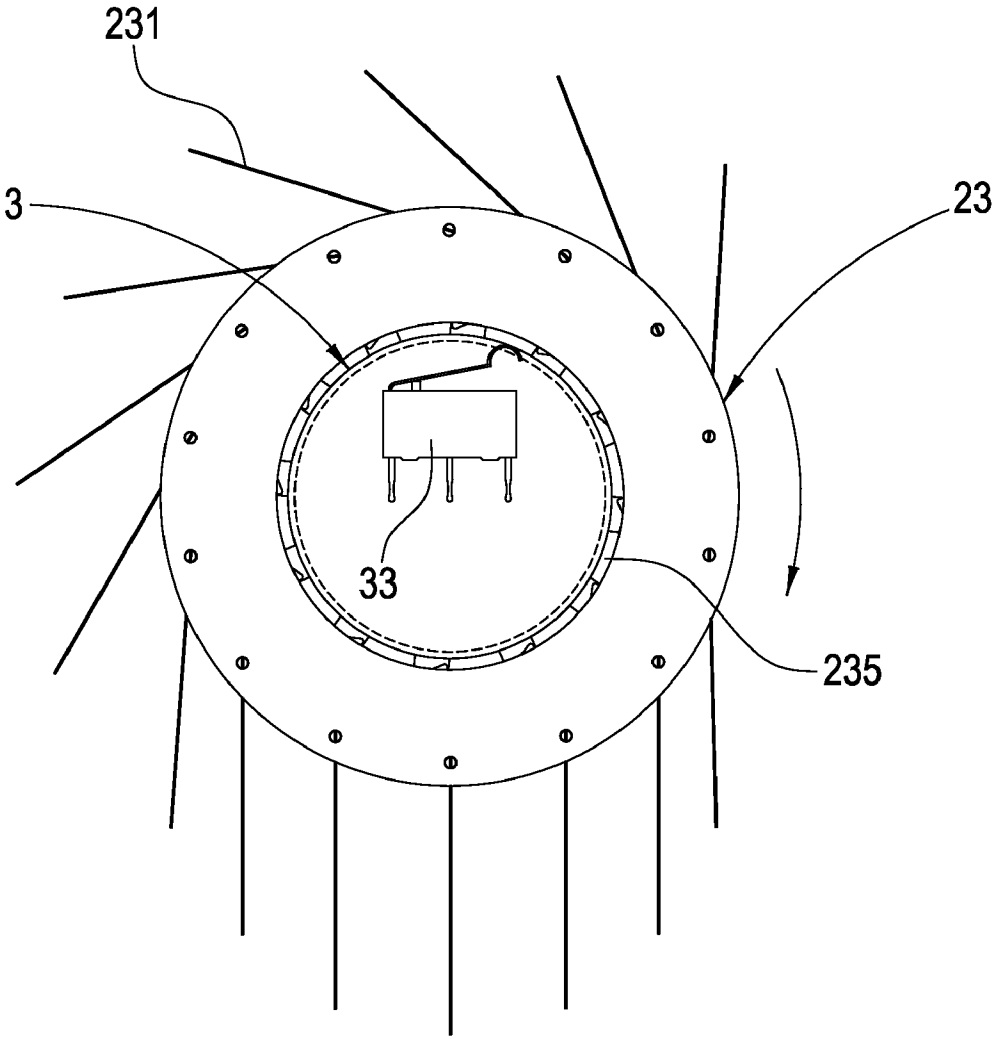

FIG. 2 is a schematic diagram of the improved structure of a perpetual calendar clock according to the present invention, shown with respect to the control signals. The rotatory touch piece 42 of the clock-control unit 4 is fixed at the rotation axis of the hour hand 41 and thus rotates with the hour hand 41; the control substrate 43 is fixed under the rotatory touch piece 42 and contacts the rotatory touch piece 42. On the control substrate 43, there is a contact surface formed in the twelve o'clock direction so that, for one cycle of rotation per twelve hours, a signal can be triggered to actuate the driving apparatuses 3. The control procedure of the present improved structure of a perpetual calendar clock is described in the following. Upon one cycle of rotation of the clock control unit 4 per twelve hours, the day-of-the-week wheel 23 is controlled to turn the corresponding tab to the next one page; as the day-of-the-week wheel 23 turns the corresponding tab to the next two page with the day of the week changed, the date wheel 22 is simultaneously driven to turn the corresponding tab to the next one page; as the date wheel 22 turns the corresponding tab by thirty-one pages, the month wheel 21 is simultaneously driven to turn the corresponding tab to the next one page. The procedure is cyclic.

The month wheel 21, the date wheel 22 and the day-of-the-week wheel 23, cooperating with the respective driving apparatuses 3 disposed therein, can rotate by constant degrees. A detailed description is set forth as follows, with regard to the flexible circuit boards 212-232 within the wheels 21-23.

For the month wheel 21, there are three sets of buses 213 associated with the flexible circuit board 212. Each bus 213 of the first set has a contact surface contacting a negative electrode; of the second set, the bus 213 having a contact surface corresponds to February; of the third set, the bus 213 having a contact surface corresponds to one of April, June, September and November; of the second and the third sets, the bus 213 having no contact surface corresponds to one of January, March, May, July, August, October and December.

For the date wheels 22, there are five sets of buses 223 associated with the flexible circuit board 222. Each bus 223 of the first set has a contact surface contacting a negative electrode; of the second set, the bus 223 having a contact surface corresponds to one of the dates ranging from 1st to 28th, and the bus 223 having no contact surface corresponds to one of the dates 1st and those ranging from 29th to 31st; of the third set, the bus 223 having a contact surface corresponds to the date 1st, and the bus 223 having no contact surface corresponds to one of the dates ranging from 2nd to 31st; of the fourth set, the bus 223 having a contact surface corresponds to the date 31 st, and the bus 223 having no contact surface corresponds to one of the dates ranging from 1st to 30th; of the fifth set, the bus 223 having a contact surface corresponds to the dates ranging from 29th to 31st, and the bus 223 having no contact surface corresponds to one of the dates ranging from 1st to 28th.

For the day-of the-week wheel 23, there are three sets of buses 233 associated with the flexible circuit board 232. Each bus 233 of the first set has a contact surface contacting a negative electrode; of the second and the third sets, the bus 233 having a contact surface corresponds to the day of the week ranging from Sunday to Saturday with AM time, while the bus 233 having no contact surface corresponds to the day of the week ranging from Sunday to Saturday with PM time.

Thus, upon one cycle of rotation of the hour hand 41 of the clock control unit 4 per twelve hours, a signal is triggered for actuating the driving apparatus 3 within the day-of the-week wheel 23 and then the deflecting rod 33 of the driving apparatus 3 within the day-of-the-week wheel 23 can deflect the inner ratchet wheel 234 at one side edge of the day-of the-week wheel 23, so that the day-of the-week tab 231 turns to the next page and displays the day of the week wheel with, say, the AM time. Upon another one cycle of rotation of the hour hand 41 per twelve hours, a signal is triggered for actuating the driving apparatus 3 within the day-of the-week wheel 23 and then the deflecting rod 33 of the driving apparatus 3 within the day-of-the-week wheel 23 can deflect the inner ratchet wheel 234 at one side edge of the day-of the-week wheel 23, so that the day-of the-week tab 231 turns to the next page and displays the day of the week wheel with, say, the PM time, a signal is triggered for actuating the driving apparatus 3 within the date wheel 22 and then the deflecting rod 33 of the driving apparatus 3 within the date wheel 22 can deflect the inner ratchet wheel 224 at one side edge of the date wheel 22, so that the date tab 221 turns to the next page and displays the proper date. Once the date wheel 22 turns the date tab 221 for thirty-one times, a signal is triggered for actuating the driving apparatus 3 within the month wheel 21 and then the deflecting rod 33 of the driving apparatus 3 within the month wheel 21 can deflect the inner ratchet wheel 214 at one side edge of the month wheel 21, so that the month tab 211 turns to the next page and displays the proper month. Yet, for February that amounts to twenty-eight days, the date tab 221 can turn to the date 1st after the date 28th, using the contact surfaces of the buses 223 of the flexible circuit board 222 of the date wheel 22 since the contact surfaces are over the three dates 29th, 30th and 31 st.

In a leap year, a downtime of one day may be taken in February that amounts to twenty-nine days, for people to adjust the tabs by hand.

FIGS. 3A and 3B and FIGS. 4A and 4B, respectively, are views of the sides of the day-of-the-week wheel of the improved structure of a perpetual calendar clock, with respect to the implementing states. Take the day-of the-week wheel 23 for example. As the motor 31 of the driving apparatus 3 within the day-of the-week wheel 23 is turned on, it actuates the deflecting rod 33 and the deflecting rod 33 deflects the inner ratchet wheel 234, so that the day-of the-week wheel 23 begins to rotate. Upon the turning on of that driving apparatus 3, the micro switch 35 of that driving apparatus 3 has not yet been pressed by the bumps 235 inside the day-of the-week wheel 23. While the rotation of the day-of the-week wheel 23 proceeds to a certain degree, the micro switch 35 is pressed by the bumps 235 so that that driving apparatus 3 is turned off. That driving apparatus 3 will remain this off state till another signal triggered.

The improved structure of a perpetual calendar clock provided by the present invention, as compared with conventional technologies, has the following advantages.

1. The present invention provides an improved structure of a perpetual calendar clock that uses touch switches for the date wheel, the month wheel, and the day-of-the-week wheel associated with the driving apparatuses so to generate step control signals for controlling the turns tabs to display the proper date, month and day of the week.

2. The present invention provides an improved structure of a perpetual calendar clock that is integrated effectively for implementation so that the entire structure becomes smaller and the product can be made lighter and simpler and thus more competitive.

3. The present invention provides an improved structure of a perpetual calendar clock that has less mechanical transmission parts so that the failure rate is lowered.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A perpetual calendar clock comprising:

an outer case, having a month window, a date window, a day-of-the-week window, and a clock window formed on one side surface thereof;

a rotatory wheel set, having a month wheel, a date wheel, and a day-of-the-week wheel, the wheels, respectively, having a month tab, a date tab, and a day-of-the-week tab disposed annularly thereon, the wheels, respectively, being aligned to the month window, the date window and the day-of-the-week window of the outer case, the wheels, respectively, having annular flexible circuit boards disposed therein, the wheels, respectively, having more than one bus disposed annularly on the inner surface thereof, the wheels, respectively, have inner ratchet wheels disposed at one edge thereof, the wheels, respectively, have more than one bump disposed on the inner surface of the edge other than that where the inner ratchet wheels are disposed, and thus the month wheel, the date wheel and the day-of-the-week wheel, respectively, being aligned to the month window, the date window and the day-of-the-week window of the outer case and a clock control unit being aligned to the clock window of the outer case;

three driving apparatuses, being respectively placed within the month wheel, the date wheel and the day-of-the-week wheel of the rotatory wheel set and being fixed within the outer case, the driving apparatuses, respectively, driving the month wheel, the date wheel and the day-of-the-week wheel to rotate, the driving apparatuses each comprising a motor, a gear set, a deflecting rod, a touch switch, and a micro switch, wherein the front end of the deflecting rod is placed on the inner ratchet wheel, a touch terminal of the touch switch touches the buses on the flexible circuit board, and the micro switch is disposed so as to correspond to the bumps; and the clock-control unit, being is fixed at the clock window of the outer case, the clock-control unit consisting of an hour hand, a rotatory touch piece, and a control substrate, wherein through the rotation of the hour hand, the rotatory touch piece is driven so as to touch a contact surface of the control substrate, and upon one cycle of rotation of the hour hand per twelve hours, a signal is triggered for controlling and actuating the driving apparatuses.

2. The perpetual calendar clock according to claim 1, wherein the outer case has functional windows formed on one side surface thereof.

3. The perpetual calendar clock according to claim 1, wherein in the month wheel, the month tab consists of twelve pages and both the number of the ratchets of the inner ratchet wheel and the number of the bumps are equal to this number of pages of the month tab.

4. The perpetual calendar clock according to claim 1, wherein in the date wheel, the date tab consists of thirty-one pages and both the number of the ratchets of the inner ratchet wheel and the number of the bumps are equal to this number of pages of the date tab.

5. The perpetual calendar clock according to claim 1, wherein in the day-of-the-week wheel, the day-of-the-week tab consists of fourteen pages, of which two pages are used for each one day to display the AM time as well as the day of the week and to display the PM time as well as the day of the week, and both the number of the ratchets of the inner ratchet wheel and the number of the bumps are equal to the number of pages of the day-of-the-week tab.

6. The perpetual calendar clock according to claim 1, wherein the touch switch has three touch terminals.

7. The perpetual calendar clock according to claim 1, wherein the touch switch has five touch terminals.

8. The perpetual calendar clock according to claim 1, wherein the outer case has a battery set disposed therein, the battery set being used for supplying power to the driving apparatuses within the month wheel, the date wheel and the day-of-the-week wheel and to the clock control unit.

9. The perpetual calendar clock according to claim 1, wherein in the month wheel, there are three sets of buses associated with the flexible circuit board and each bus of the first set has a contact surface contacting a negative electrode, the bus of the second set having a contact surface corresponds to February, the bus of the third set having a contact surface corresponds to one of April, June, September and November, and the bus of the second and the third sets having no contact surface corresponds to one of January, March, May, July, August, October and December.

10. The perpetual calendar clock according to claim 1, wherein in the date wheels, there are five sets of buses associated with the flexible circuit board and each bus of the first set has a contact surface contacting a negative electrode, the bus of the second set having a contact surface corresponding to one of the dates ranging from 1st to 28th and the bus of the second set having no contact surface corresponding to one of the dates 1st and those ranging from 29th to 31 st, the bus of the third set having a contact surface corresponding to the date 1st and the bus of the third set having no contact surface corresponding to one of the dates ranging from 2nd to 31 st, the bus of the fourth set having a contact surface corresponding to the date 31st and the bus of the fourth set having no contact surface corresponding to one of the dates ranging from 1st to 30th, and the bus of the fifth set having a contact surface corresponding to the dates ranging from 29th to 31st and the bus of the fifth set having no contact surface corresponding to one of the dates ranging from 1st to 28th.

11. The perpetual calendar clock according to claim 1, wherein in the day-of the-week wheel, there are three sets of buses associated with the flexible circuit board and each bus of the first set has a contact surface contacting a negative electrode, the bus of the second and the third sets having a contact surface corresponding to the day of the week ranging from Sunday to Saturday with AM time while the bus of the second and the third sets having no contact surface corresponding to the day of the week ranging from Sunday to Saturday with PM time.

* * * * *